US009249625B2

(12) United States Patent
Taylor

(10) Patent No.: US 9,249,625 B2
(45) Date of Patent: Feb. 2, 2016

(54) LADDER ATTACHMENT APPARATUS

(75) Inventor: Alistair Taylor, Newton Stewart (GB)

(73) Assignee: Ladder Limb Limited, Newton Stewart (GB)

( * ) Notice: Subject to any disclaimer, the term of this patent is extended or adjusted under 35 U.S.C. 154(b) by 0 days.

(21) Appl. No.: 13/817,461

(22) PCT Filed: Jul. 14, 2011

(86) PCT No.: PCT/GB2011/051321
§ 371 (c)(1),
(2), (4) Date: Feb. 18, 2013

(87) PCT Pub. No.: WO2012/022950
PCT Pub. Date: Feb. 23, 2012

(65) Prior Publication Data
US 2013/0140423 A1 Jun. 6, 2013

(30) Foreign Application Priority Data
Aug. 18, 2010 (GB) ..... 1013826.1

(51) Int. Cl.
*E06C 7/14* (2006.01)

(52) U.S. Cl.
CPC ..... *E06C 7/143* (2013.01)

(58) Field of Classification Search
CPC ..... E06C 7/143
USPC ..... 248/315, 210, 211; 182/198, 228.6, 129
See application file for complete search history.

(56) References Cited

U.S. PATENT DOCUMENTS

| | | | | | |
|---|---|---|---|---|---|
| 3,160,383 | A | * | 12/1964 | Lamm | E06C 7/143 182/129 |
| 3,223,369 | A | * | 12/1965 | Benninger, Jr. | 248/210 |
| 4,610,330 | A | * | 9/1986 | Borst | 182/90 |
| 4,655,318 | A | * | 4/1987 | Bowen | 182/90 |
| 4,660,794 | A | * | 4/1987 | Given | E06C 7/188 182/120 |
| 4,662,594 | A | * | 5/1987 | Dubis | E06C 7/143 248/231.21 |
| 4,702,446 | A | * | 10/1987 | Brown | 248/210 |
| 4,824,060 | A | | 4/1989 | Korda | |
| 4,869,342 | A | * | 9/1989 | Borst | 182/90 |
| 5,011,710 | A | * | 4/1991 | Harrison | 427/142 |
| 5,797,571 | A | * | 8/1998 | Brophy | 248/210 |

(Continued)

FOREIGN PATENT DOCUMENTS

| | | | |
|---|---|---|---|
| CA | 2037700 | A1 * | 6/1992 |
| GB | 190001368 | A | 2/1900 |

(Continued)

OTHER PUBLICATIONS

International Search Report and Written Opinion, PCT/GB2011/051321, dated Nov. 4, 2011.

*Primary Examiner* — Joshua J Michener
*Assistant Examiner* — Chiedu Chibogu
(74) *Attorney, Agent, or Firm* — Buchanan Nipper

(57) ABSTRACT

An attachment apparatus is disclosed suitable for use with ladders comprising a wedging section enabling it to be wedged into a central bore of a rung of a ladder for attachment thereto. The attachment apparatus may have a wedging section formed from a resilient material. It may further include elongate engaging section whose cross-sectional dimension is less than that of a largest dimension of a central bore of a rung of a ladder for attachment thereto. It allows a user of the such apparatus to safely suspend items such as paint pots or tools from a ladder for easy reach.

13 Claims, 9 Drawing Sheets

(56) References Cited

U.S. PATENT DOCUMENTS

| | | | | |
|---|---|---|---|---|
| 6,352,135 | B1 * | 3/2002 | Jones | 182/129 |
| 6,474,607 | B1 * | 11/2002 | Wilson | E06C 7/143 182/129 |
| 6,824,115 | B1 * | 11/2004 | Batson | E06C 7/143 182/129 |
| 7,328,853 | B2 * | 2/2008 | Carey et al. | 239/74 |
| 8,776,949 | B2 * | 7/2014 | Oswalt | 182/129 |
| 8,807,281 | B1 * | 8/2014 | Hoffman | 182/129 |
| 2007/0056999 | A1 | 3/2007 | Kahn | |
| 2007/0221802 | A1 * | 9/2007 | New et al. | 248/210 |
| 2007/0228237 | A1 * | 10/2007 | Pochurek | E06C 7/143 248/210 |
| 2008/0236691 | A1 * | 10/2008 | Roll | 138/92 |
| 2009/0308996 | A1 * | 12/2009 | Hohensee | E06C 7/143 248/238 |

FOREIGN PATENT DOCUMENTS

| | | | | | |
|---|---|---|---|---|---|
| GB | 683720 | A | | 12/1952 | |
| GB | 2356008 | A | * | 5/2001 | E06C 7/14 |
| GB | 2395514 | A | * | 5/2004 | E06C 7/14 |
| WO | WO 2005055773 | A1 | * | 6/2005 | |

* cited by examiner

LADDER ATTACHMENT APPARATUS

FIELD OF THE INVENTION

The present invention relates to apparatus that are attachable to other items, especially ladders, and may be used to attach further items to them.

BACKGROUND OF THE INVENTION

Ladders are frequently used when users have to access areas at a height. They may be widely used in such disparate fields from interior painting to maintenance of external telecommunications apparatus.

They consist, in the main, of two vertical spars connected by a set of cross-members called rungs. The rungs may be of a variety of cross sections, but are typically circular, triangular or largely cuboidal. They may be constructed from many materials, but are frequently made of metal or wood. To save on weight and material, some or all of the rungs may be hollow with a central bore.

They are not without their drawbacks however, and are the source of a multitude of accidents every year. Users may injure themselves by falling or the ladder slipping. Often this is caused by the user having to ascend the ladder with some form of hand-tool, paint-brush or the like in their hand, cutting down on the points of firm contact they have with the ladder. Further, this drawback may be exacerbated if the user is foolish enough to ascend or stand on the ladder with both hands occupied by such tools, for example, holding a paint-brush and a paint-pot, reducing their points of contact with the ladder to two: their feet. This can be extremely hazardous for the user, and the root cause of a great deal of injuries every year.

Prior art solutions include attachments that fit over the top of a set of ladders or step ladders, which have attachment sockets to receive the top of the vertical spars. These may not be possible if, as is often the case, the top of the vertical spars are resting against a wall for example. The user may wear a tool belt, but this may not be practical if they must employ some other form of harness around their waist, or is simply not a practical solution for the paint-brush and paint-pot example described above.

Further solutions include deploying an elongate bar within the hollow bore of the rung, and physically attaching it to the rung by way of a pin or a bolt arrangement. The elongate bar may be provided at one end with a shelf, allowing the user to rest, for example, a paint pot on it whilst painting.

This has several drawbacks. First, further holes must be drilled on each or all of the ladder rungs that the device will be attached to. This either has to be done as a later modification, or has to be built into ladders increasing manufacturing time and cost. Second, the holes would act as stress raisers in the rung, reducing the working capacity of the ladder and substantially increasing possible failure. Lastly, the user has to climb the ladder and will generally have to use two hands to properly fit the attachment, mitigating any benefit it may have.

SUMMARY OF THE INVENTION

According to the present invention there is provided an attachment apparatus suitable for use with ladders comprising a wedging section enabling it to be wedged into a central bore of a rung of a ladder for attachment thereto. By "wedged" the addressee skilled in the art will appreciate that the wedging section will be of a suitable form as to enable it to be placed, secured and held within an appropriate central bore, merely by the central bore compressing at least a portion of it. An interference fit of the two will then be formed, albeit that manual force should be sufficient to disengage the resultant interference fit.

The wedging section may be formed from a resilient material. The resilient material may be rubber, a suitable plastics material, or some other suitable resilient material. The resilient material may be confined to the construction of the wedging section, or may be used to form other parts of the attachment apparatus.

The attachment apparatus may further include an elongate engaging section whose cross-sectional dimension is less than that of a largest dimension of a central bore of a rung of a ladder for attachment thereto.

The wedging section may be of a generally frustum shape. The wedging section may be of a generally conical frustum shape. The elongate engaging section may extend from the face having the smaller cross-sectional area of the frustum or conical frustum.

Alternatively, the wedging section may comprise one or more lips surrounding a central wedge member. The lips may be toroids if the central wedge member is of a circular cross-section, the toroids themselves having a suitable cross-section, ranging from circular, through elliptical or rectangular or square cross section.

Such an arrangement may comprise a plurality of such lips, decreasing in diameter along a central axis of the attachment apparatus in the direction of its attachment.

As a further alternative, the wedging section may include a simple lug arrangement, projecting from a side of a central wedge member. There may be a plurality of such lugs, and it may be that their subsequent projecting distances decreasing along a central axis of the attachment apparatus in the direction of its attachment. Thus, a frustum like overall shape may be attained, without a fully formed frustum being required. The lugs may be arranged in ring-like sets at common distances along the attachment apparatus, or may be placed in any suitable arrangement pattern.

The attachment apparatus may include further connection means, such connection means including a hook, or even a karabiner. Alternatively, the further connection means may include a snap-hook, clip, shelf or other suitable form of connection means for the application.

BRIEF DESCRIPTION OF THE DRAWINGS

Embodiments of the present invention will be described, by way of example only, with reference to the accompanying drawings, in which.

DETAILED DESCRIPTION OF THE PREFERRED EMBODIMENTS

Figure 1:
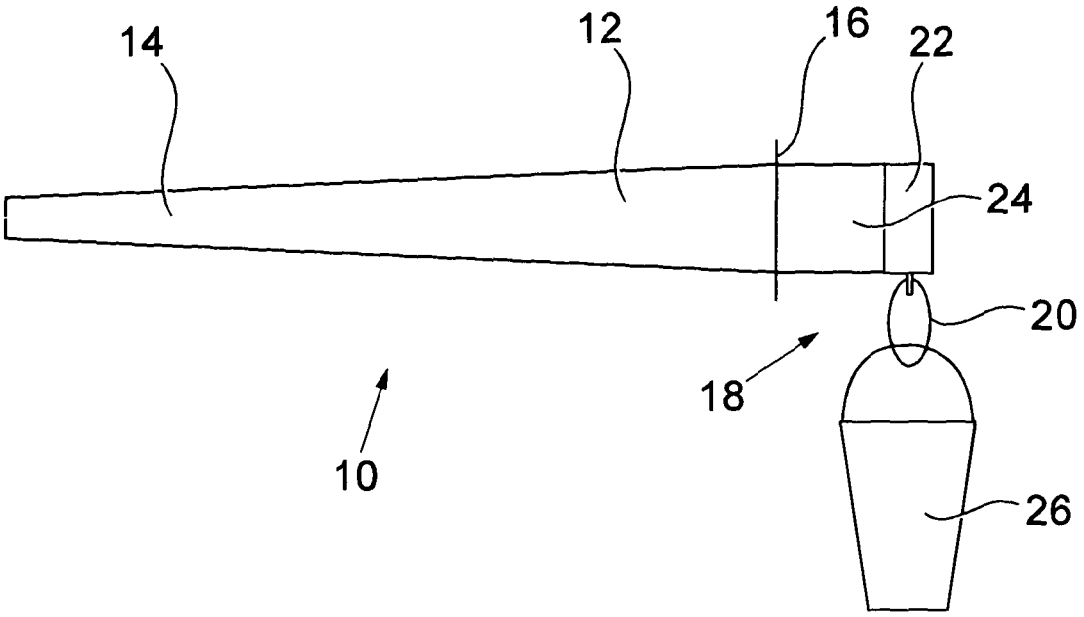
FIG. 1 is a side view of a first embodiment of an attachment apparatus according to the present invention.

An attachment apparatus 10 according to the present invention is depicted in FIG. 1. It includes a wedge section 12, extending from which is elongate engaging section 14. In this particular embodiment, a flange 16 extends around the distal end of the wedge section 12. The flange 16 in this embodiment prevents over insertion of the attachment member 10 into a ladder.

The wedge section 12 and elongate engaging section 14 in this embodiment form a continuous conical frustum shape, although it will be appreciated that the form may be more discontinuous, for example the elongate engaging section 14 may be generally cylindrical, attaching to a conical frustum wedge section 12, or indeed the elongate section 14 may be generally cylindrical, and the wedge section 12 may comprise a plurality of lips extending around it. Numerous modifications and alternatives exist to this arrangement, as will be apparent to those skilled in the art.

The wedge section 12 is formed on its outer surface from rubber, to provide suitable resilience. In this embodiment, the rubber is a layer over a metal body, but may be, for example, a fully rubber attachment, or may be based on a polycarbonate material.

Extending from the flange 16 on the distal end of the wedge section 12 is further connection means 18. The further connection means 18 includes a snap-hook or karabiner 20. The snap-hook/karabiner 18 is attached to an end cap 22, which itself is attached onto a connection member 24.

On this embodiment, a paint-pot 26 it shown attached to the attachment apparatus 10 via the further connection means 18.

Figure 2:
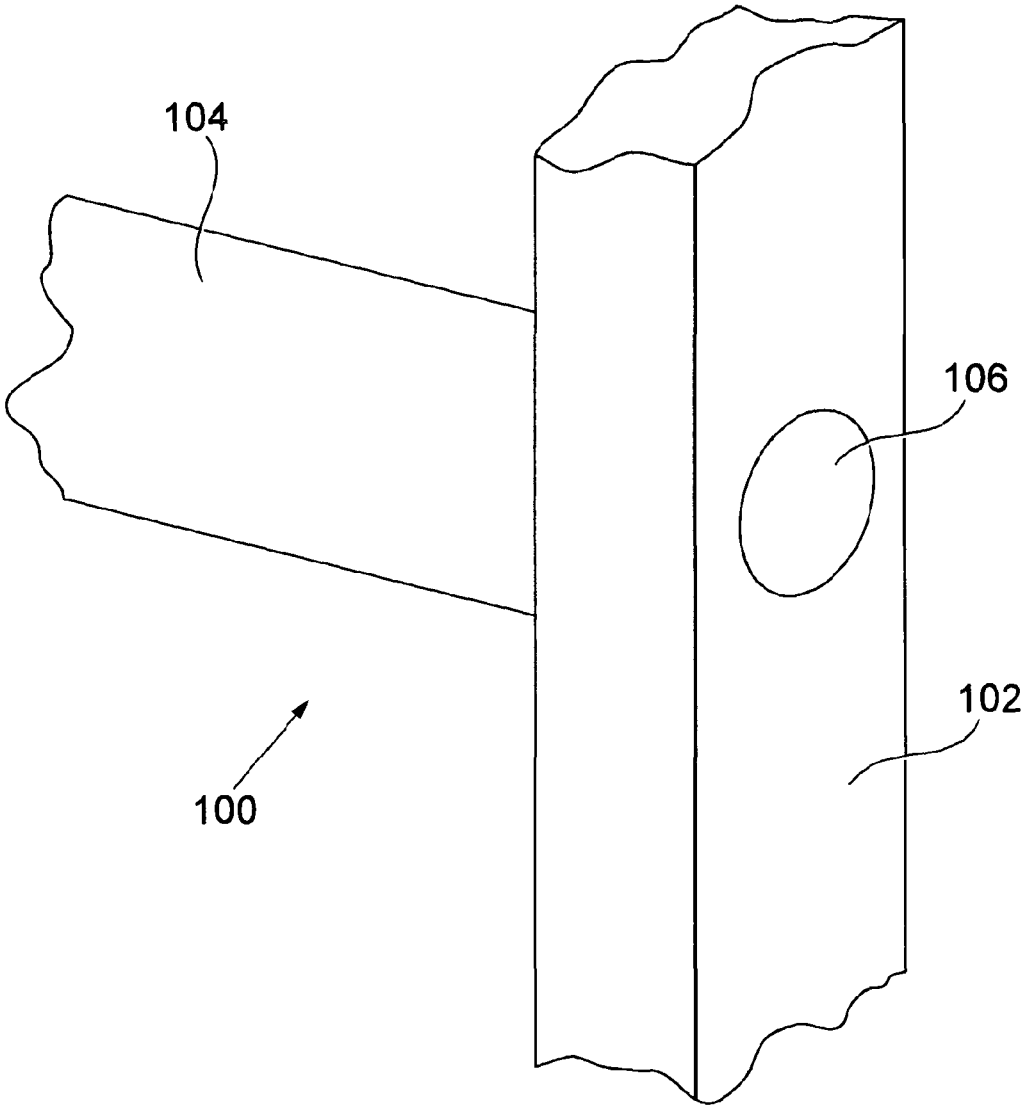
FIG. 2 is a part isometric view of a ladder suitable for use with the attachment apparatus of FIG. 1.

FIG. 2 shows a detail view of a ladder 100 suitable for use with the attachment apparatus 10. The ladder 100 is of a known type and includes two vertical spars 102 (only one shown in FIG. 2), both being attached by a plurality of rungs 104 (only one shown in FIG. 2). A central bore 106 is provided through each rung 104.

In use, the user will ascend the ladder 100 using the rungs 104 with the attachment apparatus 10 to the appropriate height. The user will insert the attachment apparatus into the ladder 100 via the central bore 106 of rung 104. The attachment apparatus 10 will be fed into the central bore 106 engaging section 14 first. Eventually the side walls of the wedge section 12 will begin to contact the interior wall of central bore 106. The user will feel a resistance to further insertion, as the rubber of the wedge section 12 is compressed by the action of insertion.

Eventually the user will reach the point where further insertion is impeded beyond the manual force that can be exerted by the user. However, by this point, the wedge section 12 will have formed an interference fit inside the central bore 106.

Figure 3:
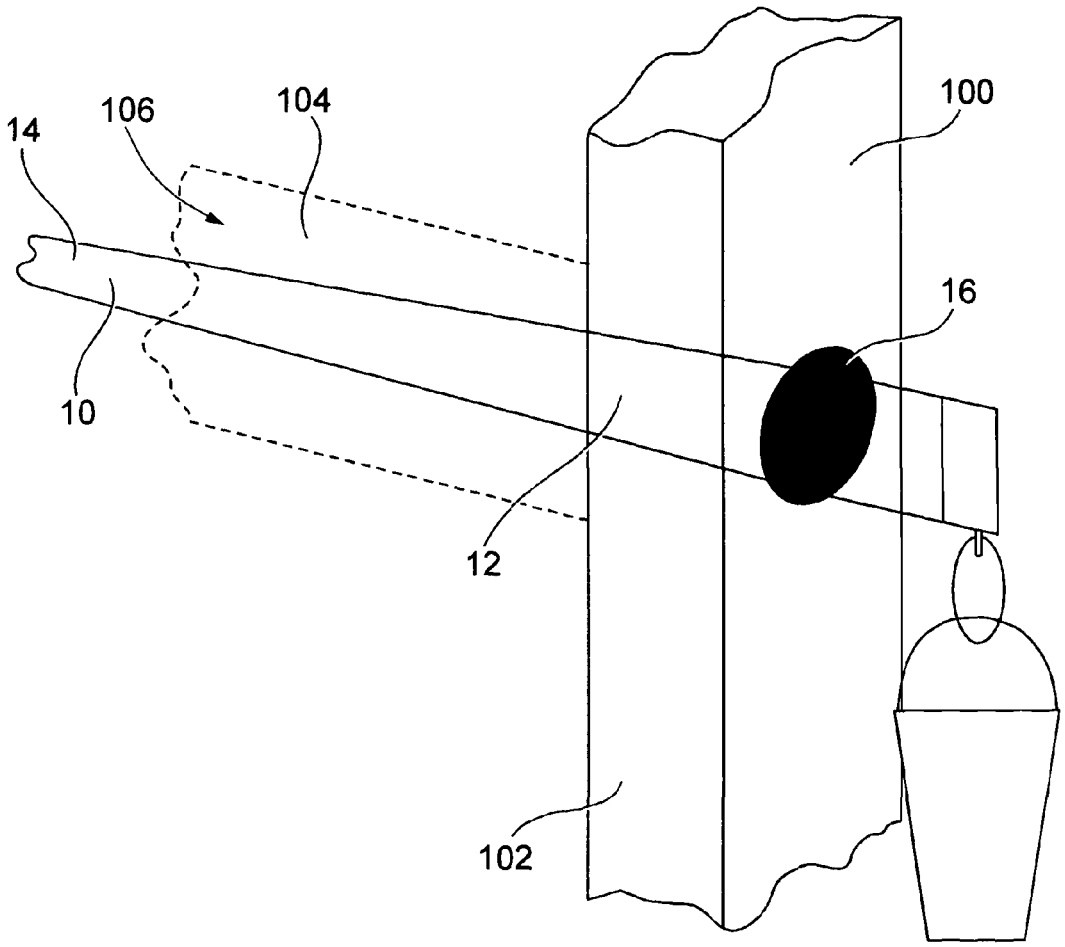
FIG. 3 is a part sectional isometric view of the attachment apparatus of FIG. 1 attached to the ladder of FIG. 2.
Figure 4:
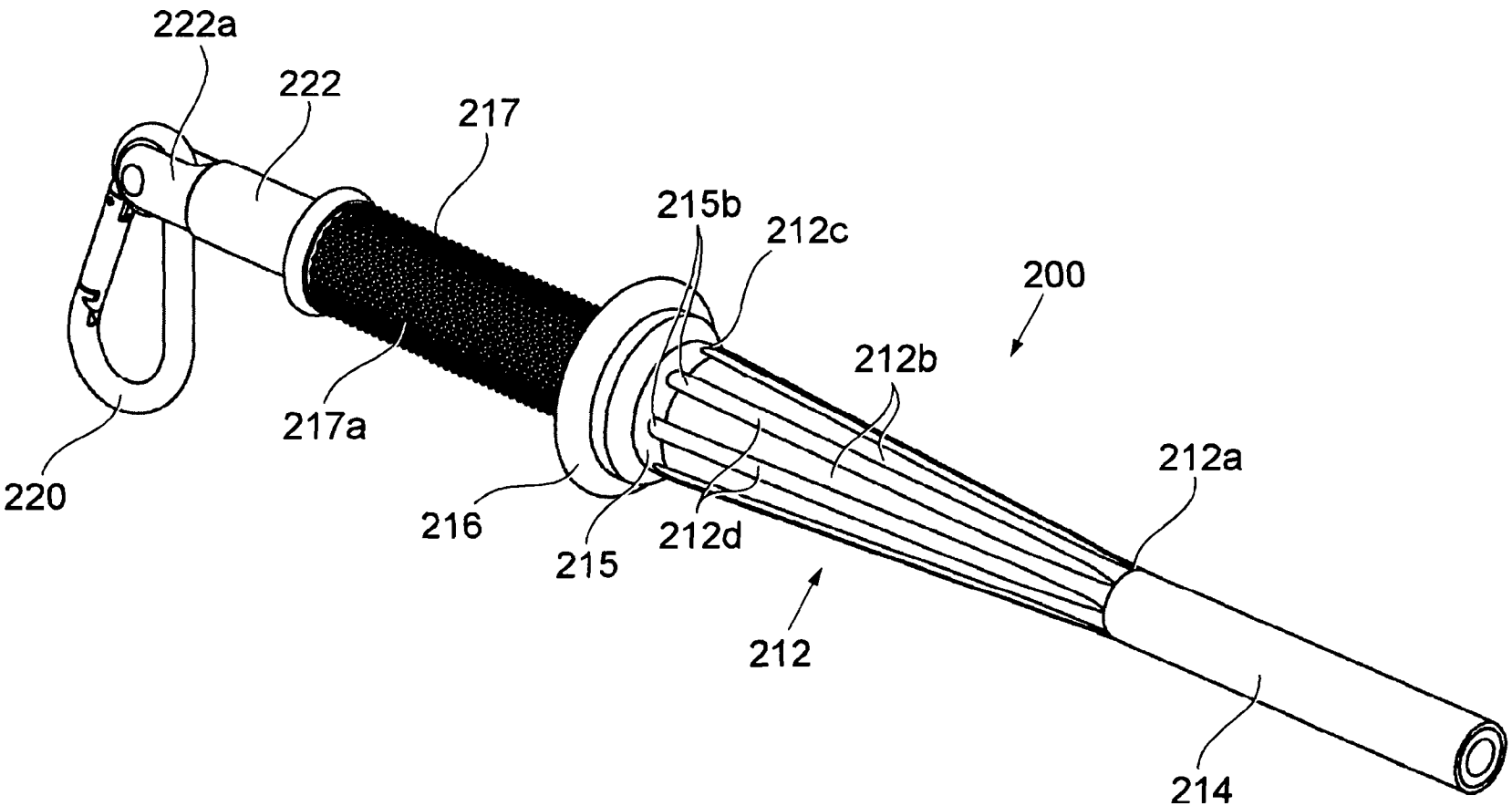
FIG. 4 is a perspective view of a second embodiment of an attachment apparatus according to the present invention.
Figure 5:
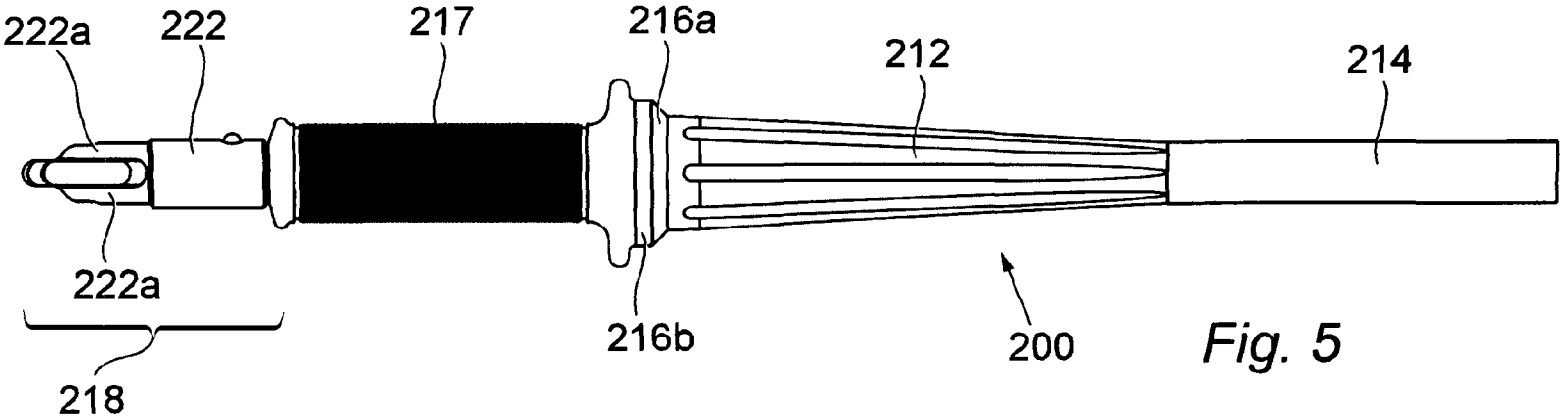
FIG. 5 is a plan view of the attachment apparatus of FIG. 4.
Figure 6:
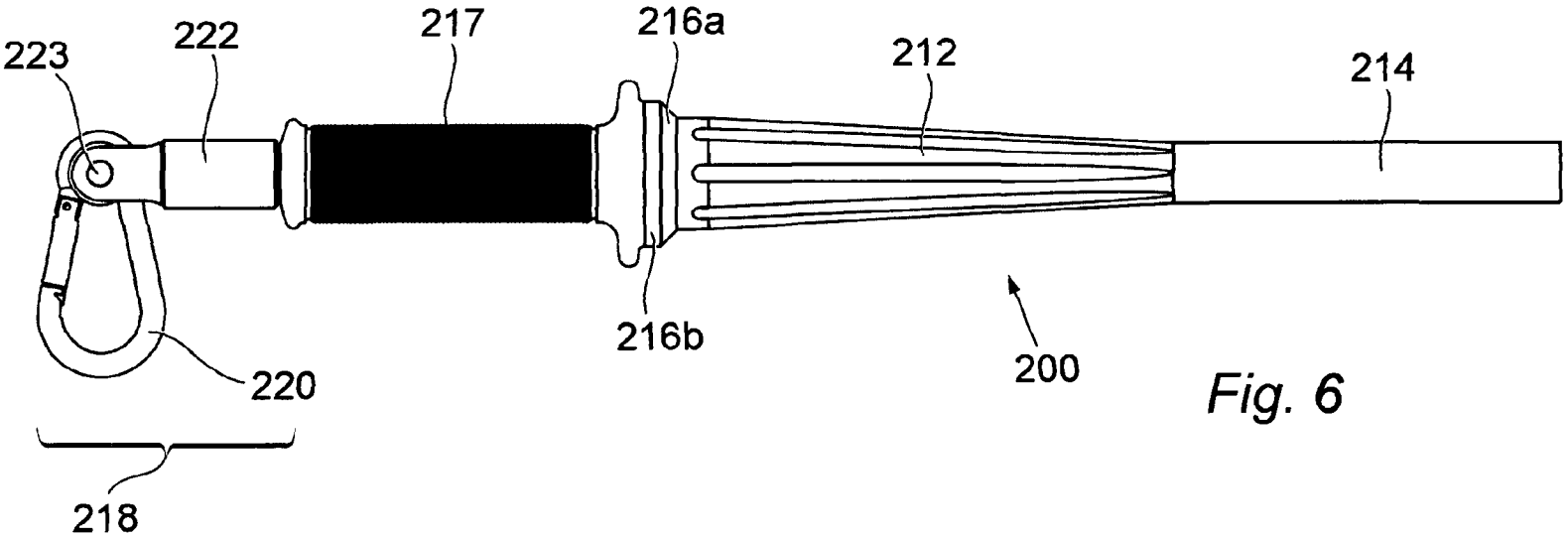
FIG. 6 is a side elevation of the attachment apparatus of FIG. 4.
Figure 7:
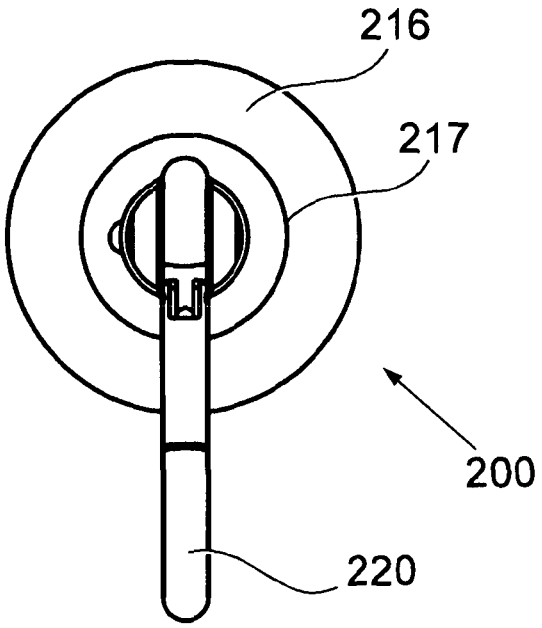
FIG. 7 is a first end view of the attachment apparatus of FIG. 4.
Figure 8:
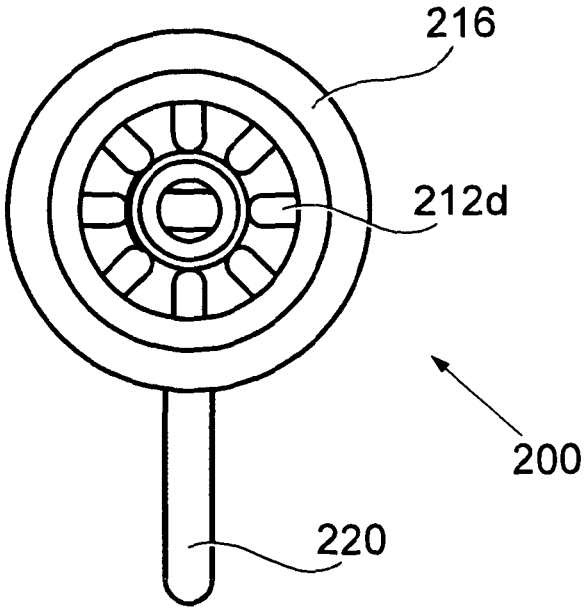
FIG. 8 is a second end view of the attachment apparatus of FIG. 4.

This situation is shown in FIG. 3, with the attachment apparatus 10 engaged with the ladder 100. In this configuration, the engaging section 14 is positioned within the central bore 106. The wedge section 12 forms an interference fit with the interior wall of central bore 106 at the end of the rung 104 nearest vertical spar 102. The flange 16 abuts the vertical spar 102.

The user may then attach any tool or further attachment suitable for their specific requirements. This may be a bag containing a host of suitable tools or equipment.

A second embodiment attachment apparatus 200 is shown in FIGS. 4 to 9. The apparatus 200 comprises a frusto-conical wedge section 212 from the narrowest diameter end 212*a* of which extends a cylindrical elongate portion 214. The frusto-conical wedge section 212 comprises a plurality of axially extending ribs 212*b*. These ribs 212*b*form the frusto-conical section by projecting outwardly from the attachment apparatus 200 in a substantially linearly increasing fashion from the narrowest diameter end 212*a*, to the greatest diameter end 212*c* of the frusto-conical wedge section 212. In between each ribs 212*b* are formed spacings 212*d*. The ribs 212*b* may be formed from a resilient material such as a rubber to provide suitable resilience.

Extending from the greatest diameter end 212*c* of the frusto-conical wedge section 212 is a short cylindrical section 215. It can be seen from FIGS. 4-8 that in the present embodiment there are formed small semi-circular recesses 215*b* on the short cylindrical section 215 that are adjacent and equal in number to the spacings 212*d*, forming a contiguous spacing.

Adjacent the short cylindrical section 215 opposite the frusto-conical wedge section 212, is a flange 216. The flange 216 comprises a frusto-conical flange section 216*a*, and a cylindrical flange section 216*b*.

A handle 217 is attached to the flange 216 opposite the frusto-conical wedge section 212. The handle 217 is formed from a rubber grip 217*a*, allowing the apparatus 200 to be manually manipulated by a user.

Extending from the handle 217 is further connection means 218. The further connection means 218 includes a snap-hook or karabiner 220. The snap-hook/karabiner 220 is attached to an end cap 222, from which two lugs 222*a* project. The snap-hook/karabiner 220 attaches between the two lugs 222*a* by way of a simple pin arrangement 223.

Figure 9A:
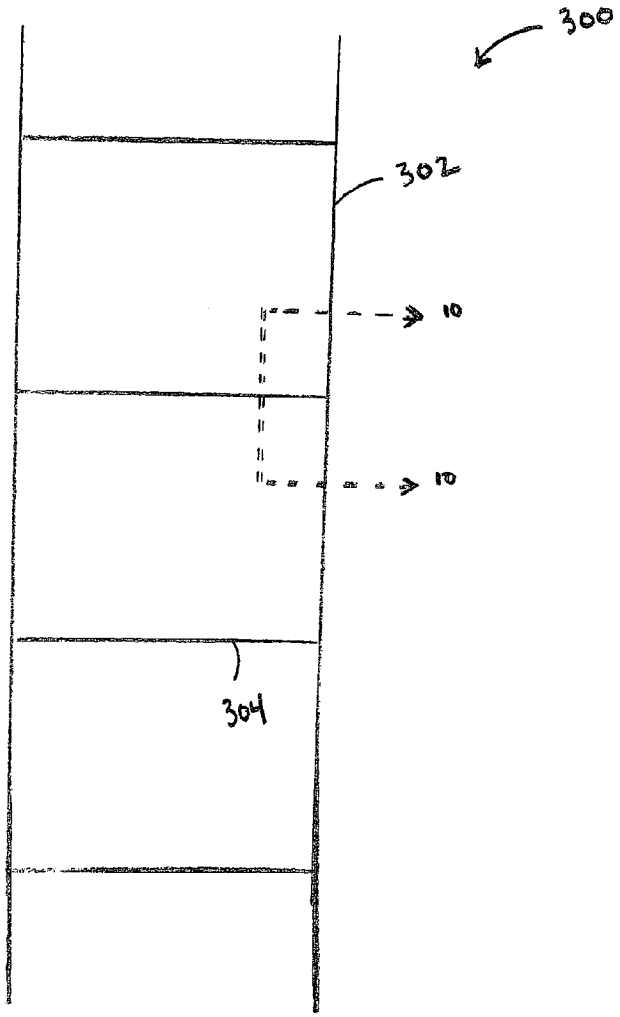
FIG. 9A is a front view of the attachment apparatus of FIG. 4 attached to the ladder of FIG. 2.
Figure 9B:
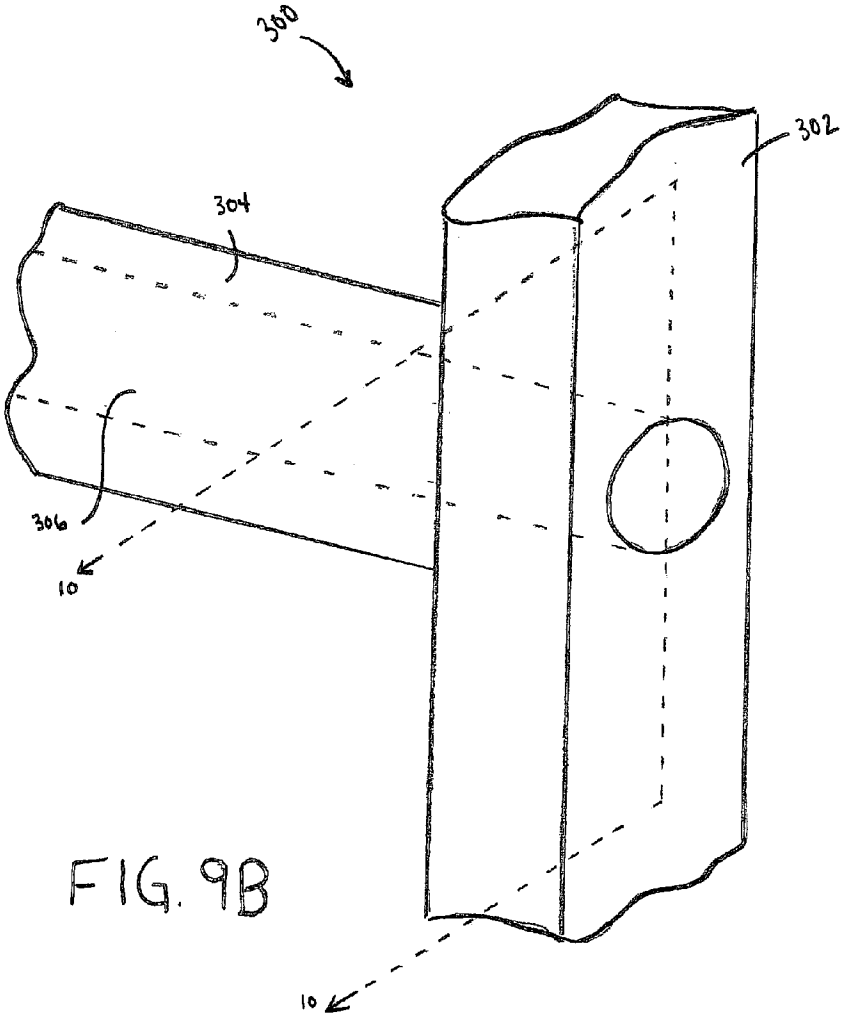
FIG. 9B is a perspective view of the attachment apparatus of FIG. 4 attached to the ladder of FIG. 2.
Figure 10:
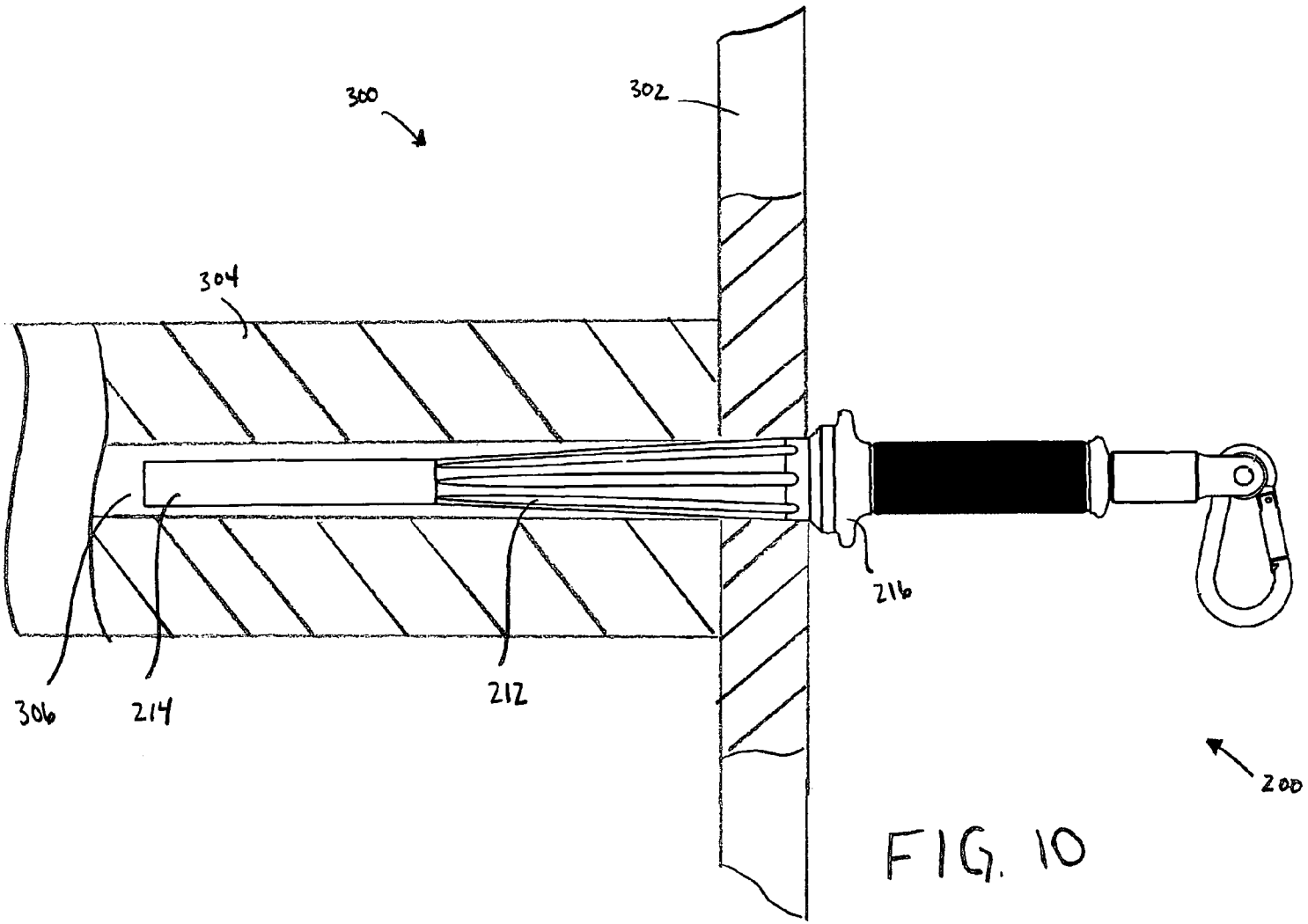
FIG. 10 is a cross-sectional view taken in the direction of line 10-10 of FIGS. 9A and 9B.

FIGS. 9A, 9B and 10 illustrate the attachment apparatus 200 engaged with the ladder 300. In this configuration, the engaging section 214 is positioned within the central bore 306. The wedge section 212 forms an interference fit with the interior wall of central bore 306 at the end of the rung 304 nearest vertical spar 302. The flange 216 abuts the vertical spar 302.

It will be obvious to the skilled addressee that the apparatus may be inserted on either side to suit a left or right-handed user. Moreover, the use of the karabiner means that a paint-pot, for example, is locked in placed and it becoming disconnected is impeded.

Moreover, once in place, the use of the present invention allows the user to maintain three points of contact with the ladder at all times. For example, the user may maintain a firm grip with one hand on the ladder, use a paint-brush with the other hand, with the paint-pot being held securely in the attachment apparatus.

The invention is not limited to the embodiment described herein, and further modifications and improvements may be made to the present invention without departing from its scope.

For example, although described here as being a conical frustum shape, the wedging section may comprise one or more lips surrounding a central wedge member. The lips may be toroids if the central wedge member is of a circular cross-section, the toroids themselves having a suitable cross-section, ranging from circular, through elliptical or rectangular or square cross section.

Such an arrangement may comprise a plurality of such lips, decreasing in diameter along a central axis of the attachment apparatus in the direction of its attachment.

As a further possible alternative, the wedging section may include a simple lug arrangement, projecting from a side of a central wedge member. There would preferably be provided a plurality of such lugs, more preferably their subsequent projecting distances would decrease along a central axis of the attachment apparatus in the direction of its attachment. Thus, a frustum like overall shape may be attained, without a fully formed frustum being required. The lugs may be arranged in ring-like sets at common distances along the attachment apparatus, or may be placed in any suitable arrangement pattern.

Furthermore, although described here as a karabiner, the attachment means may include a normal hook, a cord, as shelf, or other suitable form of connection means for the application.

Although described herein with a smooth leading edge, the elongate engaging section 14 may be provided with a suitable mechanism for varying its effective diameter once deployed. For example, three spring-loaded fingers may be provided on the leading edge which are initially flush with the elongate member. Once the attachment apparatus is suitably engaged with a ladder, the fingers may be deployed to increases the effective diameter of the elongate engaging section 14 and biasing against the inner wall of the central bore 106.

The invention claimed is:

1. An attachment apparatus suitable for use with a ladder having a plurality of rungs, at least one of said rungs comprising a central bore having an internal dimension, said attachment apparatus comprising:

a frustro-conical wedging section formed from a resilient material, said frustro-conical wedging section configured for wedging into said central bore for attachment thereto, said frustro-conical wedging section further comprising a plurality of axially extending ribs, wherein said ribs radially project outwardly from said frustro-conical wedging section, each rib longitudinally extends from a narrowest diameter end of the frustro-conical wedging section to a greatest diameter end of the frustro-conical wedging section, the height of the outwardly projection of each rib away from the frustro-conical wedging section substantially linearly increases beginning from the narrowest diameter end of said frustro-conical wedging section to the greatest diameter end of said frustro-conical wedging section, each rib is separated from an adjacent rib by a groove and each groove has a first end and a second end which are distally opposed from one another, the first end of each groove narrows to a point and terminates at the point such that the end portion of the adjacent ribs located at the narrowest diameter of the frustro-conical wedging section contact one another, the second end of each groove is wider than the first end of each groove;

an elongate engaging section whose cross-sectional dimension is less than said internal dimension of said central bore, the elongated engaging section is integrally connected with the frustro-conical wedging section at the narrowest diameter of the frustro-conical wedging section and longitudinally extends away therefrom in a first axial direction; and a handle section adapted to permit a user to insert the frustro-conical wedging section into the central bore, the handle section comprising a gripping portion and a flange, the flange being located between the gripping portion and the frustro-conical wedging section, the flange being sized to prevent the handle section from being inserted into the central bore, the handle section is integrally connected with the frustro-conical wedging section via the flange at the greatest diameter of the frustro-conical wedging section and extends away therefrom in a second axial direction which is opposed to the first axial direction.

2. An attachment apparatus according to claim 1 wherein, further comprising a connector for connecting a tool and/or a container, the connector being located at an end of the handle section opposite the flange, the handle section configured for spacing the tool and/or container away from the ladder, the connector being adapted to pivot with respect to the handle section.

3. An attachment apparatus according to claim 1 wherein the ribs are adapted to form a non-continuous circumferential interference fit with the central bore such that each rib is in contact with an internal surface of the central bore.

4. An attachment apparatus according to claim 1 wherein the ribs are adapted to form an interference fit with the central bore such that each rib is in contact with the central bore, the adjacent ribs resiliently deforming to at least partially close a spacing therebetween.

5. An attachment apparatus according to claim 1 wherein the handle section includes a connector adapted to lock an item to be attached to the attachment apparatus so that the item can be supported on the ladder via wedging of the frustro-conical wedging section into the central bore.

6. An attachment apparatus according to claim 5 wherein the connector is a karabiner.

7. An attachment apparatus according to claim 1, further comprising a first end and a second end, wherein a free end portion of said elongated engaging section distal from the frustro-conical wedging section is said first end, wherein said elongate engaging section is adapted to be inserted into the central bore, and wherein a free end portion of the handle section distal from the frustro-conical wedging section is said second end, and said second end comprises a pivotally mounted connector for connecting a tool and/or a container to the attachment apparatus.

8. An attachment apparatus according to claim 1 wherein an end portion of the handle section distal from the frustro-conical wedging section comprises a lug arrangement comprising a plurality of lugs, the lugs projecting in the second axial direction and away from the flange.

9. An attachment apparatus according to claim 1, further comprising a connector for connecting a tool and/or a container.

10. An attachment apparatus according to claim 9, wherein said connector comprises a hook.

11. An attachment apparatus according to claim 10, wherein the hook is connected to an outer end of the handle section.

12. An attachment apparatus according to claim 11, wherein said handle section comprises a rubber grip.

13. An attachment apparatus according to claim 10, wherein said hook comprises a karabiner.

* * * * *